United States Patent [19]

Breslow et al.

[11] 4,337,948

[45] Jul. 6, 1982

[54] GAME APPARATUS

[75] Inventors: Jeffrey D. Breslow, Highland Park; Donald A. Rosenwinkel, Tinley Park, both of Ill.; Steven P. Hanson, Brea, Calif.; Rex M. Harper, Chicago, Ill.

[73] Assignee: Marvin Glass & Associates, Chicago, Ill.

[21] Appl. No.: 119,824

[22] Filed: Feb. 8, 1980

[51] Int. Cl.[3] ..... A63F 3/00; A63F 9/00

[52] U.S. Cl. ..... 273/237; 273/1 GC; 273/288

[58] Field of Search ..... 273/1 E, 1 GC, 58 E, 273/58 G, 183 B, 237, 238, 288-291; 200/61.45 R, 61.45 M, 61.46, 61.48, 61.52

[56] References Cited

U.S. PATENT DOCUMENTS

| | | | |
|---|---|---|---|
| 3,179,416 | 4/1965 | Budi | 273/289 |
| 3,812,726 | 5/1974 | Bell | 200/61.45 R |
| 3,843,132 | 10/1974 | Ferguson | 273/238 |
| 4,022,998 | 5/1977 | Fohl | 200/61.45 R |
| 4,163,560 | 8/1979 | Solomon | 273/288 X |
| 4,207,087 | 6/1980 | Morrison et al. | 273/1 E |

*Primary Examiner*—J. D. Miller
*Assistant Examiner*—Peter S. Wong
*Attorney, Agent, or Firm*—Mason, Kolehmainen, Rathburn & Wyss

[57] ABSTRACT

A game apparatus includes a manually movable game object having a finite number of generally planar exterior surfaces upon which the game object may rest. In one embodiment, a game board includes indicia defining positions of placement and movement of the game object as it is rotated about an edge from one planar surface to another. The game object includes an internal microcomputer capable of detecting which one of the planar surfaces is generally parallel with or in contact with the game board or any other suitable supporting surface to identify the discrete positions of movement of the game object. The microcomputer may provide an identifying sensorially perceptible signal identifying the various discrete positions. In addition, the microcomputer includes a storing unit for storing sequential movements of the game object through a finite number of movements. The microcomputer also identifies player turns for movement of the game object and provides a sensorially perceptible event at the end of a player's turn or at the end of a game when an incorrect movement of the game object is made or when a movement is not attempted within a predetermined time period.

35 Claims, 5 Drawing Figures

Fig 1
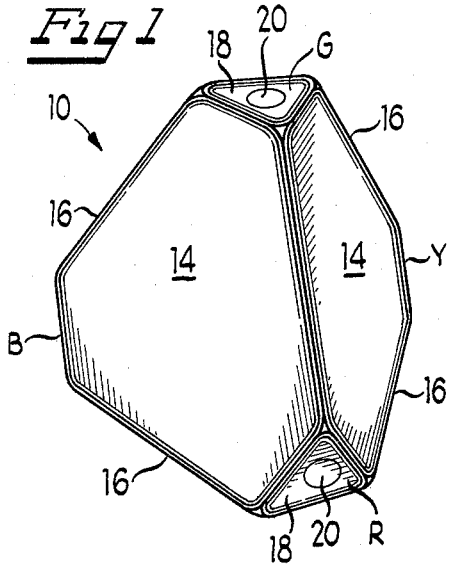
Fig 2
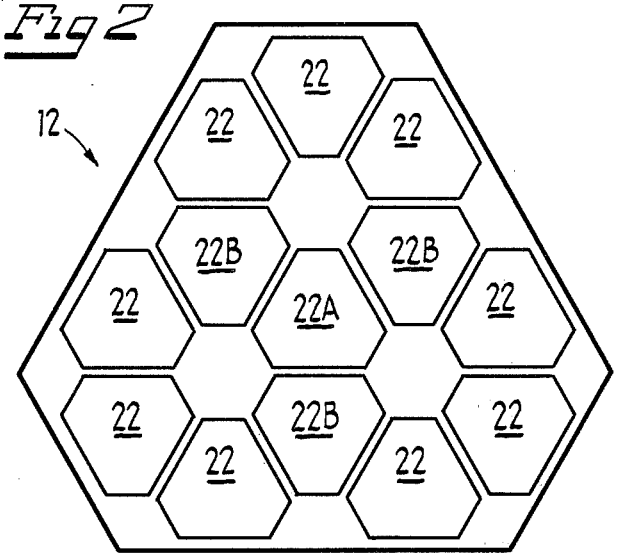
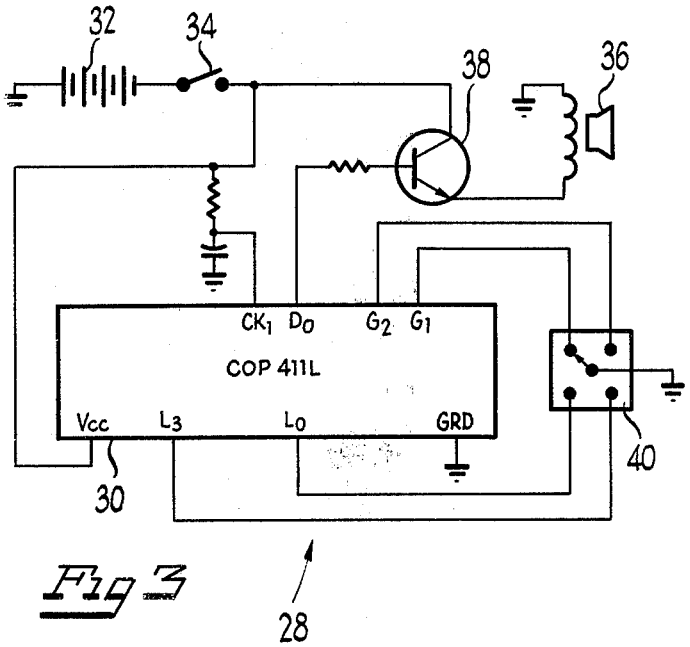
Fig 3
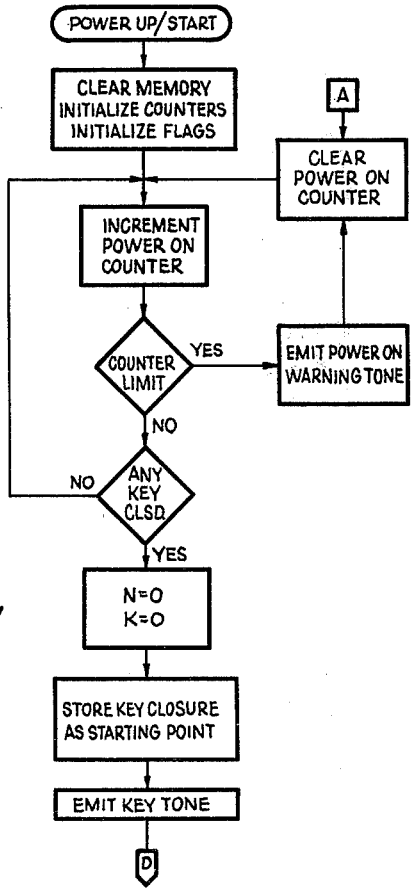
Fig 4

GAME APPARATUS

BACKGROUND OF THE INVENTION

1. Field of the Invention

The present invention relates to games, and in particular, to a game having a game object which is capable of remembering its own previous movements.

2. Brief Description of the Prior Art

Electronic games are known, for example, the electronic keyboard game disclosed in United States Letters Patent Application Ser. No. 834,643 filed Sept. 19, 1977, now U.S. Pat. No. 4,207,087, and assigned to the assignee of the present invention. This game apparatus discloses an arrangement in which the keys of a keyboard are associated with a tone or light and the device utilizes a minicomputer to generate a sequence of tones each associated with one of the key switches on the keyboard. If the participant correctly repeats the sequence the machine adds another event to the sequence and plays the sequence again which must then be repeated by the participant. Also, electronically controlled games simulating the well known game of "Battleship" are known wherein a microprocessor is employed to store the secret location of each player's battleship and to provide an indication when the opposing player's keyboard selection of areas sinks the battleship.

While these electronic games provide a great deal of amusement, they have not generally provided a game wherein the game object itself is movable to discrete positions and capable of identifying and storing the various positions to which it is moved.

SUMMARY OF THE INVENTION

It is an object of the present invention to provide an electronic board game in which a game object is movable and includes means for identifying the positions to which it is moved.

It is another object of the present invention to provide a new and improved electronic game board wherein said sensorially perceptible events are produced to identify the positions to which the game object is moved.

It is another object of the present invention to provide a new and improved electronic game board wherein a player's movement of the game object is identified and stored so that a sequence of moves can be repeated and identified as being correct or incorrect.

In accordance with these and other objects, the above invention includes a manually movable game piece having a finite number of exterior surfaces. In one embodiment, a game board includes indicia defining positions of placement and movement of the game piece as it is rotated about an edge from one planar surface to another. The game piece includes a microcomputer means for detecting and storing the movements of the game piece, for example, which one of the surfaces is in contact with a support surface to identify the discrete positions of movement of the game piece. Means are also provided to produce an identifying sensorially perceptible signal identifying the various discrete positions. The microcomputer also identifies player turns for movement of the game object and provides a sensorially perceptible event at the end of a player's turn or at the end of a game when an incorrect movement of the game piece is made or when a movement is not attempted within a predetermined time period.

BRIEF DESCRIPTION OF THE DRAWINGS

These and other objects and advantages of the present invention will become more apparent by reference to the following description taken in conjunction with the accompanying drawings, wherein:

FIG. 1 is a perspective view, on an enlarged scale, of a preferred embodiment of a game object made in accordance with the concepts of the present invention;

FIG. 2 is a top plan view of a game board for use with the game object of FIG. 1;

FIG. 3 is a detailed schematic diagram of the electronic circuitry of the game according to the concepts of the present invention; and FIGS. 4 and 5 are logical flow charts illustrating the operation of one scheme of play of the game according to the concepts of the present invention.

DESCRIPTION OF THE PREFERRED EMBODIMENT

Figure 5:
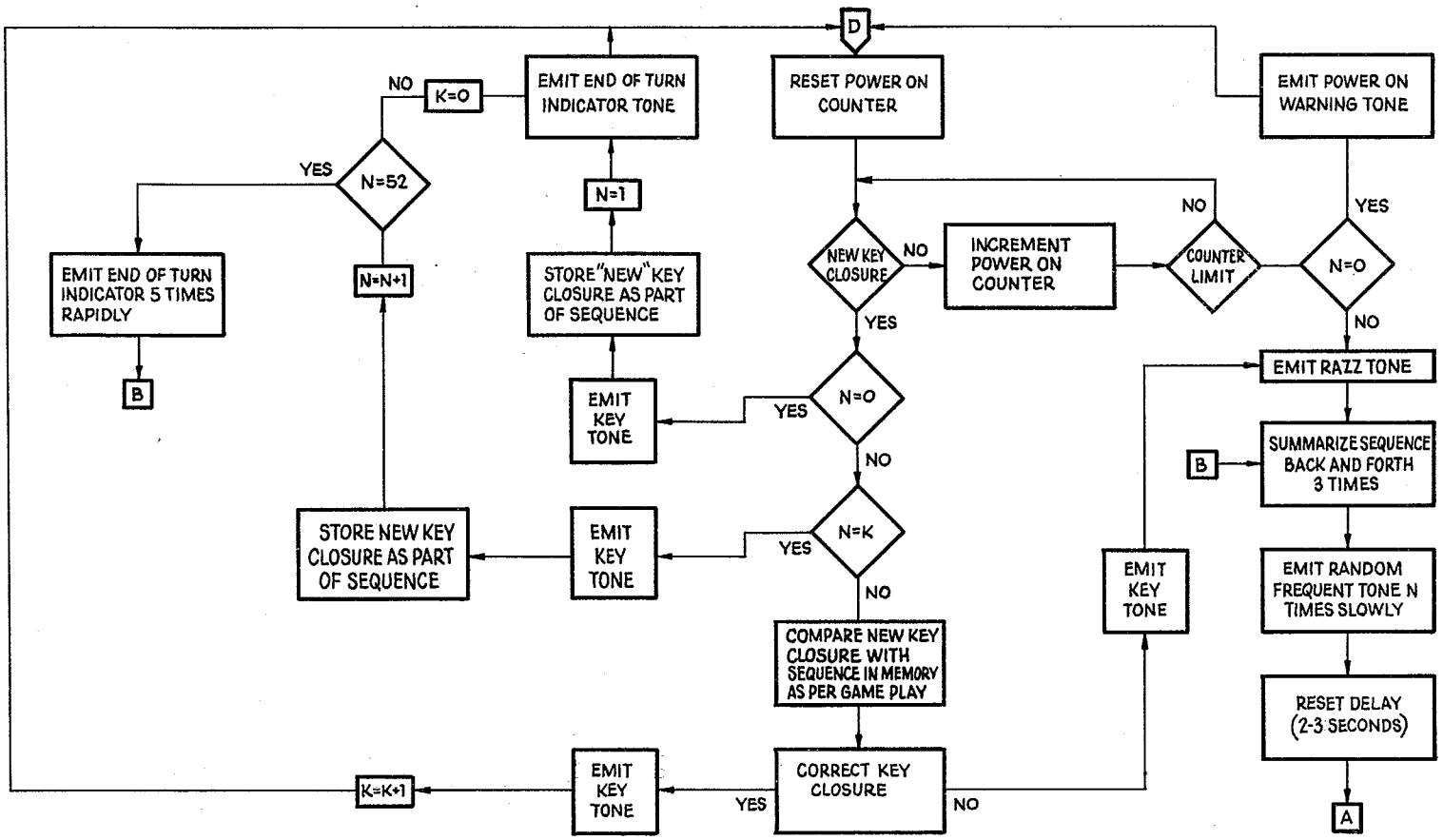

A game apparatus made in accordance with the present invention includes a game piece, generally designated 10, in FIG. 1 and a game board, generally designated 12 in FIG. 2. In the preferred embodiment, the game piece 10 includes a housing with a plurality of generally planar sides 14 adjoining one another at connecting edges 16. As shown in FIG. 1, the game piece 10 is generally in the shape of a regular tetrahedron formed by four congruous equilateral triangles. However, for simplicity and safety reasons, the pointed ends or vertexes of the tetrahedron have been rounded as will be described in detail hereinafter. As shown and described in the Specification, the game piece is in the shape of a regular tetrahedron having four faces each of which is an equilateral triangle. However, the game object may take the shape of a hexahedron, octahedron, dodecahedron, icosahedron or any other polygon. In the preferred embodiment, each one of the rounded vertexes includes means for identifying that particular vertex. For example, in the preferred embodiment, each of the vertexes carries an end plate or end cap 18 which is of a particular color. For example, the four vertexes of the game piece 10 shown in FIG. 1 are designated as being green, red, yellow and blue by the appropriate letters G, R, Y and B, respectively. To give additional interest and flair to the game piece 10, a central area or plug 20 may provide additional indicating means for particular uses. A color photograph of one particular embodiment which has been constructed and tested is shown in a color photograph attached hereto in Appendix A.

A game board 12 made in accordance with the concepts of the present invention is shown in FIG. 2. The game board 12 shown in the drawing has been illustrated on a reduced scale. The game board has a plurality of game piece positions 22 each of which are defined by an outline around the periphery. The outline or shape defining the playing positions on the game board are the same size and shape as one of the faces 14 of the game piece to be used in conjunction with the game board. For example, in the embodiment illustrated, the playing spaces are generally in the shape of an equilateral triangle with the vertexes clipped so as to match the shape of one of the faces 14 on the game piece 10. In addition, the outer periphery of the game board defines a shape which is similar to, but substantially larger than any one of the playing spaces. In this particular illustration, the game board shown provides sixteen playing positions. However, many additional positions could be provided on a larger game board. Also, if the game piece 10 were made of a different polygon, a cube or hexahedron, for example, each of the playing positions 22 would be a square and the perimeter of the entire game board would be square.

During one scheme of play of the game, the game piece 10 is positioned on the center position 22*a* and moved to various positions by rolling or rotating the game piece about one of its edges 16. It can therefore be seen that the game piece which begins on the position 22*a* must be moved to one of the three positions 22*b* upon rotation about one of the edges 16 of the face 14 lying adjacent to or on top of the game board 12. One of the colored apexes G, R, Y and B will thus always be pointed upwardly so that a particular position can be defined as green, for example, when the green vertex is pointed upwardly, and so on.

The play of the game is accomplished by means mounted within the game piece 10 which are capable of detecting and identifying movements of the game piece such as through the use of a microcomputer 28 as shown in the schematic of FIG. 3. The electrical schematic includes a microprocessor 30 and associated elements represented by the standard symbols. In this particular case, the microprocessor chosen is a COP411L single chip N-channel microcontroller manufactured by National Semiconductor Corporation of 2900 Semiconductor Drive, Santa Clara, California. An information sheet showing the block diagram and describing the features and characteristics of this particular microprocessor is enclosed in Appendix A attached to and made a part of this application. In addition to the microprocessor, the schematic includes a power supply 32 which is contemplated to be four "AA" dry cell batteries providing between 4.5 and 6.3 volts of DC power. A manually operable on-off switch 34 disconnects the power supply and may be provided at any point on the housing of the game piece 10. As will be described hereinafter, the microcomputer means 28 will provide a plurality of sensorially perceptible signals, and in the embodiment shown includes a transducer 36 such as a speaker for providing audible signals. The speaker is driven by a transistor 38 in a conventional fashion. Lastly, the microcomputer is connected to a mechanical element, which in the preferred embodiment, is a four-position tilt switch 40. The four-position tilt switch is mounted within the housing of the game piece 10 and oriented such that one of the four discrete positions G, R, Y or B causes a contact to be made between ground and one of the four positions. This requires orientating the tilt switch 40 within the housing so that when one of the faces 14 rests flush with a horizontal game board or other suitable supporting surface, one of the four discrete positions will be indicated. As will be evident to the reader, when a different type polygon is utilized as the game piece 10, a similar change is required in the tilt switch, which for example, would be a six-position tilt switch for a cubic or hexahedron game piece. Thus, the tilt switch 40 informs the microprocessor 30 which position the game piece is in at a particular time. A schematic drawing showing the values of each of the components of the circuitry as well as the identification of the pins on the microprocessor is also enclosed with the Appendix.

In one play of game, as contemplated by the present invention, the change in position of the game piece 10 as it is rotated about an edge 16 includes a component of translation as well as rotation and is identified by the change in the contact made by the four-position tilt switch and since there are only four discrete positions of rest for the game piece 10. It is contemplated, within the spirit and scope of the present invention, that other types of game piece movements could be similarly detected by appropriate detecting means, other than the tilt switch 40. For example, if the game piece were merely moved in a particular direction without any rotation, the movement could be detected by an accelerometer or inertial movement detecting device. Similarly, other known devices could be used to detect rotation alone with no lineal movement or translation thus providing variations of the game of the present invention.

Generally, the play of the game described hereinafter is designed for two players who begin with the playing piece 10 on the center position 22*a* and alternately move the playing piece 10 to various positions gradually building a longer and longer sequence of switch closures for the four-position tilt switch. As described previously, there are four possible switch positions, G, R, Y and B. The microprocessor 30 is programmed to provide each switch position, and therefore, each discrete, rest position of the game piece, with its own unique tone which is sounded whenever a switch closure for the tilt switch 40 is detected. For example, the game begins by one of the players turning the power switch 34 on and placing the game piece 10 on the center position 22*a* of the game board 12. The microprocessor provides an audible signal to indicate that the power is on. The first player then rotates the game piece 10 about one of the edges 16 to one of the adjacent playing positions 22*b*. For clarity, we will assume that the game piece began in the "R" position and is moved to the "G" position with the green end cap pointed upwardly. The microprocessor is programmed to produce a sensorially perceptible event, in this case, an audible signal whenever a new switch closure is detected. In the preferred embodiment described, the microprocessor produces an audible signal of a unique predetermined frequency for each one of the positions. The frequencies are defined as follows: for the green position, 250 Hz; for the yellow position, 333 Hz; for the blue position, 500 Hz; and for the red position, 1000 Hz. The tone duration is between 150 and 200 msec for each position. Thus, after the first player has moved the game object 10 to the green position, the green or 250 Hz signal is produced. In addition, since the first player has now made a move which increases the length of the sequence, it is the end of his turn and it now becomes player number 2's turn to make a play. In order to identify the switch to a new player, a "end of turn indicator" is produced. For example, when either players turn is over, the microprocessor must respond with the player's last position tone followed immediately by the "end of turn indicator". The "end of turn indicator" consists of all of the position sounds played rapidly in ascending order, i.e., 250-333-500-1000 Hz with a duration of 75–100 msec for each tone.

The second player then begins his turn by back-tracking the entire sequence, which after the first move is only one movement of the game object, before adding his own movement to the sequence. For example, moving the game object 10 from the G position to the starting position R and then one increment or additional movement to, for example, position B. During this movement, the microprocessor produces the appropriate tones at the R position then at the B position and then immediately after the tone for the B position is produced, the microprocessor will respond with the "end of turn indicator".

Player one then resumes by moving from the blue position through the red position through the green position and adds an increment of one to, for example, the Y position. During this move, the red position, green position and yellow position tones are heard in sequence followed by the "end of turn indicator". Play will then continue back and forth with each player adding one more position until one of the following three things happens:

(1) either one of the players makes an error during his turn in attempting to repeat the sequence by moving the game piece 10 to a position which is not within the sequence, or (2) either one of the players delays for too long or takes too much time, which exceeds a predetermined time limit, between movements of the game piece between positions, or (3) player one successfully achieves a sequence maximum of movement of the game piece 10 through 28 positions.

A typical game is shown diagrammatically below in which player one makes an error on his fourth move by moving the game piece to the yellow position rather than the correct blue position.

STARTING POSITION IN CENTER OF BOARD

| PLAYS | Player #2's Sequence | Player #1's Sequence |
|---|---|---|
| A. Starting Point: | | R |
| B. Player #1's turn: | | R → G* |
| C. Player #2's turn: | *B ← | R ← G |
| D. Player #1's turn: | B → | R → G → Y* |
| E. Player #2's turn: | *G ← B ← | R ← G ← Y |
| F. Player #1's turn: | G → B → | R → G → Y → R* |
| G. Player #2's turn: | *R ← G ← B ← | R ← G ← Y ← R |
| H. Player #1 errs: | R → G → Y# | |

* "End of Turn Indicator" sounds immediately after last position tone.
#Player makes error and game is terminated as described.

When either one of the players makes an error, an error signal or "razz" sound is produced. The frequency of the "razz" tone of the present invention has been selected as 180 Hz for a duration of approximately two seconds. If any of the players, in the course of a game play, makes an error in repeating a previous sequence by moving the game object 10 to an improper position, the following occurs. The error signal or "razz" tone will be generated and the entire game tone sequence of the positions is rapidly summarized with each tone being sounded for 50 msec with a 10 msec pause between tones. For example, for the game set forth in the above chart, the microprocessor would summarize the entire game sequence as R-R-G-G-R-B-B-R-G-Y-Y-G-R-B-G-G-B-R-G-Y-R-R-Y-G-R-B-G-R since that was the last correct move. The microprocessor then uses one of the four position tones, chosen at random, to slowly count off the total length of both players sequences added together. This counting uses a pause duration of one second and a pause duration of 500 msec between tones. The starting point is not considered a part of either player's sequence. For example, in the game previously described, the microprocessor would count off six tones indicating that each player had successfully achieved a sequence length of three.

If in the course of play of the game, one of the players does not make a move from one position to the other within a predetermined time period of approximately 15–20 seconds, the microprocessor will respond with an "error" tone or "razz" and then signal the end of a game by rapidly summarizing the entire game sequence and count off as described above. The memory of the COP411L microprocessor utilizing the preferred embodiment naturally has a limited memory. Therefore, according to the programming of the game described, this memory is full after the initial player has achieved a sequence length of 28 moves and the second player has achieved a sequence length of 27 moves. If this occurs, the microprocessor will respond with an "end of turn indicator" repeated five times in rapid succession and will then rapidly summarize the entire game sequence and count off as described above up to a total number of moves, which is 55.

At the conclusion of any game, the microprocessor is designed to reset itself without requiring a manual operation of the on-off switch 34. After the scoring count off of a game is completed, the microprocessor will reset itself and sound a position tone depending upon which position the game object is in. This tone will occur 3–5 seconds after the scoring and count off so as not to be confused with the countoff itself in the event that the countoff tone randomly chosen is the same as that position. If, however, after the initial power up or after being reset at the conclusion of any game, and the game is not played, i.e., the game object 10 is not moved to a new position within the 15–20 second predetermined period, the microprocessor will give the "end of turn indicator" to indicate that the power is on but that the game is not being played. This provides an audible signal for young children that, if they are not going to continue to play the game, the off-on switch must be turned to the off position to reserve power for the batteries 32. The device will continue to produce the "end of turn indicator" every 15–20 seconds until the game is played or preferably shut off or until the output of the batteries 32 is insufficient.

A logical flow diagram describing the programming of the microprocessor 30 in accordance with the preferred embodiment of the present invention to perform the functions necessary to play the game described hereinbefore is shown in FIGS. 4 and 5. Many modifications of the present game such as changing the shape of the polygon of the game object 10 are possible. For example, the game can easily be played in a solitaire manner where a particular player attempts to continue to repeat his own sequence or with more than two players wherein each player is merely required to repeat the previously played sequence. For example, referring to the chart on page 11, the play designated "D" could be player 3's turn and the play designated "E" could be player 4's turn, then play "F" could return back to player 1, etc. On the other hand, the game could be made extremely more challenging by providing programming for a three or four player game wherein several different sequences could be stored. A slide switch could be utilized to select a particular playup mode, for example, with two, three or four players in which the game could sequentially eliminate players who make an error and continue until one player remains after all players have been eliminated.

The foregoing detailed description has been given for clearness of understanding only and is intended to be exemplary of the invention while not limiting the invention to the exact embodiment shown. Obviously many modifications and variations are possible in light of the above teachings and it is to be understood that within the scope of the appended claims, the invention may be practiced otherwise than specifically hereinbefore described.

What is claimed and desired to be secured by United States Letters Patent is:

1. A game apparatus, comprising:
a game object having a housing with a finite number of sides;
means within said object for detecting rotation of the object between two of said sides;
storage means, electrically connected to said detecting means, for recording a sequence of rotary movements of said object; and
means, electrically connected to said storage means for subsequently providing an indication of said sequence of movements.

2. The game apparatus of claims 1, wherein said housing includes means defining a finite number of discrete positions to which the housing is movable.

3. The game apparatus of claim 2 wherein said defining means comprises a plurality of sides.

4. The game apparatus of claims 1, wherein said housing is a regular tetrahedron.

5. The game apparatus of claim 3 wherein each side of said housing defines a discrete position of rest for the housing.

6. The game apparatus of claim 1 wherein said detecting means is capable of detecting orientation changes, acceleration changes, velocity changes and any combination thereof.

7. The game apparatus of claim 6 wherein said means for indicating said movement comprises an accelerometer.

8. The game apparatus of claim 7 wherein said detecting means comprises a multiple position tilt switch.

9. The game apparatus of claim 8 wherein said tilt switch is capable of identifying four discrete positions.

10. The game apparatus of claim 9 wherein said storage means further comprises a microprocessor for identifying and storing all previous movements of said housing.

11. The game apparatus of claim 10 including means for defining a game of play wherein the housing is moved from an initial position to a first position on one play and back through the initial position to a second position on a subsequent play.

12. The game apparatus of claim 11 wherein the sequence is incremented by one movement during each play of the game.

13. The game apparatus of claim 12 including means for signaling movement of the housing to a discrete position.

14. The game apparatus of claim 13 including an end of play signal for identifying the end of a move.

15. The apparatus of claim 1 wherein said detecting means includes means for detecting the direction of rotation of said object.

16. The apparatus of claim 1 wherein said object includes a multifaceted housing, said detecting means including means for determining which of said facets is arranged parallel to the ground.

17. The apparatus of claim 1 wherein said indicating means includes means for comparing a subsequent sequence of rotary movements of said object with a prior sequence of rotary movements of said object and means for indicating whether said sequences are identical.

18. The apparatus of claim 17 wherein said indicating means includes means for indicating whether said subsequent sequence is in reverse order from said prior sequence.

19. The apparatus of claim 17 wherein said indicating means includes means for producing an indication immediately following a movement in a subsequent sequence of movements that does not correspond to the related movement in a prior sequence.

20. A game apparatus, comprising:
a game object;
means on the game object for defining a finite number of discrete positions to which said game object can be moved;
means within said object for detecting rotation of said object;
storage means electrically connected to said detecting means, for recording a sequence of rotary movements of said object;
means, electrically connected to said recording means, for subsequently providing an indication of said sequence of movements;
a game board;
means on said game board for indicating the finite number of discrete positions to which said game object can be moved.

21. The game apparatus of claim 20 wherein said game board includes indicating means thereon representative of the means on the game object for defining the discrete positions for locating the game object relative to its previous position.

22. The game apparatus of claim 21 wherein said game object includes a plurality of sides, each side defining one of said discrete positions.

23. The game apparatus of claim 22 wherein said game object is a regular tetrahedron.

24. The game apparatus of claim 23 wherein the indicating means on the game board comprises a plurality of equilateral triangles congruous with the shape of each side of the game object.

25. The game apparatus of claim 24 wherein the pointed ends of the tetrahedron are flattened.

26. The game apparatus of claim 25 wherein the apexes of the equilateral triangles are truncated.

27. The game apparatus of claim 26 wherein the shape of the game board is similar to the shape of any one of said indicating means.

28. A board game apparatus, comprising a movable game object having a finite number of planar sides;

a game board having a surface over which said game object is movable;

means for identifying which one of the finite number of sides of the game object is generally parallel with the surface of the game board;

means for storing the sequential movements of said object from one planar side to another, and means, electrically connected to said storing means for subsequently providing an indication of the sequence of movements undergone by said object.

29. The game board apparatus of claim 28 including means on the game object for storing sequential movements of the game object from side to side.

30. The game apparatus of claim 29 wherein said game object is a regular tetrahedron having four generally triangular sides.

31. The game apparatus of claim 30 wherein said game board includes indicating means thereon congruous in shape to one of the sides of same game object for identifying various positions of play for the game object.

32. A game apparatus, comprising:

a movable game object having a finite number of sides;

means for detecting the movement of the object between two of said sides;

storage means, electrically connected to said detecting means, for recording a sequence of movements detected by said detecting means;

means, electrically connected to said storage means for comparing a subsequent sequence of movements with an earlier sequence of movements recorded in said storage means; and indicating means for indicating whether said earlier and subsequent sequences are the same.

33. The game apparatus of claim 32 wherein said detecting means detects the direction of movement of said object.

34. The game apparatus of claim 32 wherein said detecting means is located within said object.

35. The game apparatus of claim 32 wherein said detecting means detects rotary movements of said object.

* * * * *